US010024639B2

(12) United States Patent
Veschi et al.

(10) Patent No.: US 10,024,639 B2
(45) Date of Patent: Jul. 17, 2018

(54) CARTRIDGES FOR FIREARMS, CONSTRUCTION PROCESS AND RELATED CONSTRUCTION EQUIPMENT

(71) Applicants: Stefano Veschi, Riccione (IT); Gianni Paci, Modigliana (IT)

(72) Inventors: Stefano Veschi, Riccione (IT); Gianni Paci, Modigliana (IT)

( * ) Notice: Subject to any disclaimer, the term of this patent is extended or adjusted under 35 U.S.C. 154(b) by 59 days.

(21) Appl. No.: 14/903,790

(22) PCT Filed: Jun. 27, 2014

(86) PCT No.: PCT/IB2014/062672

§ 371 (c)(1),
(2) Date: Jan. 8, 2016

(87) PCT Pub. No.: WO2015/004561

PCT Pub. Date: Jan. 15, 2015

(65) Prior Publication Data

US 2016/0153754 A1 Jun. 2, 2016

(30) Foreign Application Priority Data

Jul. 11, 2013 (IT) ..... RN2013A0027

(51) Int. Cl.

| | |
|---|---|
| ***F42B 14/00*** | (2006.01) |
| ***F42B 7/12*** | (2006.01) |
| ***F42B 7/04*** | (2006.01) |
| ***F42B 33/00*** | (2006.01) |

(52) U.S. Cl.
CPC ..... *F42B 7/12* (2013.01); *F42B 7/046* (2013.01); *F42B 33/001* (2013.01)

(58) Field of Classification Search
CPC ..... F42B 7/02; F42B 33/02
USPC ..... 86/18, 19.5, 19.6, 25
See application file for complete search history.

(56) References Cited

U.S. PATENT DOCUMENTS 2,232,634 A * 2/1941 Roberts ..... F42B 7/04 102/462
2,300,367 A 10/1942 Harmon
3,055,302 A * 9/1962 Eckstein ..... F42B 7/12 102/463
4,991,512 A * 2/1991 Van Wyk ..... F42B 7/12 102/462

FOREIGN PATENT DOCUMENTS

FR 1277139 A 11/1961
FR 2298782 A1 8/1976

* cited by examiner

*Primary Examiner* — J. Woodrow Eldred
(74) *Attorney, Agent, or Firm* — Volpe and Koenig, P.C.

(57) ABSTRACT

The present invention concerns a cartridge for firearms comprising a cartridge case with a crown of wings. The wings themselves are fused or glued to one another so as to form an ogival closing element of the cartridge case. The invention also concerns the process for manufacturing the cartridge and the relative equipment.

3 Claims, 7 Drawing Sheets

CARTRIDGES FOR FIREARMS, CONSTRUCTION PROCESS AND RELATED CONSTRUCTION EQUIPMENT

The present invention concerns a cartridge for firearms, its manufacturing process and the equipment for carrying out such a process.

It is the intention of the applicants to name the cartridge of the present invention, and to later disclose it to the public, as a cartridge with a PACI closing system.

The present invention has been made with particular reference to cartridges with pellets/shots that are intended for smooth barrelled weapons and are commonly used for hunting or trapshooting.

A cartridge of the known type is shown in FIGS. 1 and 2 and is indicated with reference numeral 1. It comprises a primer 5, a propellant charge 10 (gun powder), a wad 15, a bullet or pellets/shots 20, and their container 25, called "cartridge case".

As shown in FIGS. 1 and 2, the known cartridge comprises a closing element 30 that is commonly called "star-shaped".

This closing element has the characteristic of being flat, with a raised edge, thus being very resistant to the stresses caused when being inserted into an automatic loader of a modern rifle. This is obtained by making a series of folds on the tip of the cartridge case so as to form wings 35 that are folded so as to engage with one another (FIG. 2).

Since these are extremely delicate and potentially dangerous objects, the requirement of applying considerable force in order to carry out the engagement of the folds does not make the manufacturing process an optimal choice.

Moreover, from the ballistic point of view, such a closing element has some limitations. Firstly, it requires quite a high extraction load. The extraction load is the "force" with which the pellets must push in order to open the cartridge case and come out. Such a load is such as to generate a deformation in the pellets and to influence the uniformity of the distribution of the "pattern" of pellets on the target.

The extraction load, in concert with other details of the configuration of the cartridge, also influences the peak pressure that is generated at the moment of shooting.

In order for a cartridge to be able to be used in a weapon without danger, i.e. without the exploding of the weapon itself, the peak pressure must remain below certain values. The star-shaped closure, having a high extraction load, per se leads to a tendency towards high peak pressure, and therefore gives limitations to the management of the other configuration parameters of the cartridge, like for example the amount of gun powder or of pellets.

Finally, since the star-shaped closure is obtained through coupling, it is not sealed with respect to atmospheric agents, therefore it needs to be stored with a certain amount of care.

One general purpose of the present invention is therefore that of completely or partially solving the problems of the prior art.

One preferred purpose of the present invention is that of providing a cartridge with a closing element that requires less extraction load with respect to the star-shaped closure.

Another preferred purpose of the present invention is that of providing a cartridge that is more resistant to atmospheric agents.

A further preferred purpose of the present invention is that of providing a system for making a cartridge that is cost-effective and can be repeated with reliable results.

Another further purpose of the present invention is that of providing equipment for closing a cartridge that is easy and cost-effective to make.

According to its first general aspect, the present invention concerns a cartridge for firearms comprising a cartridge case with a crown of wings. The wings themselves are fused or glued to one another so as to form an ogival closing element of the cartridge case.

Advantageously, for the same amount of powder contained in the cartridge, in order to open when shooting, this type of closure in general requires a lower extraction load of the cartridge with the star-shaped closing element, and the combustion of the powder tends to be more progressive, therefore there is a peak pressure that tends to be lower. The cartridge is thus more reliable and makes it possible for there to be a wide variability in the configuration.

For example, the advantage in terms of peak pressure can be exploited at a configuration level by loading the cartridge with a greater amount of pellets/shots, or by increasing the amount of powder so as to increase the firing speed.

In addition to the advantages indicated above the deformation of the pellets is small or negligible, and their pattern is more even, with respect to known cartridges with a flat star-shaped closing element.

For all these reasons shooting can potentially be more precise and/or effective on the target and the shooting distance can be greater than cartridges with a star-shaped closure.

A further advantage of the closing element according to the present invention is that it is sufficiently resistant to stresses that are generated between the cartridges inserted in a rifle with an automatic loader, so that it is very reliable for use with modern weapons and it overcomes the prejudice of flat star-shaped closures with a raised edge being the only ones that are suitable for this purpose.

According to some preferred embodiments the closure fusion is present only at the vertex of the ogive. For example, the vertex closure is present in an area that extends around the longitudinal axis at the most for a distance that is shorter than or equal to ¼ of the maximum width of the closing element itself in a radial direction with respect to the longitudinal axis.

In such a manner, advantageously, an area with greater concentration of material is involved in the fusion due to the fact that here the walls of the wings are closer to one another, and therefore there is no formation of holes in the walls of the closing elements, increasing the probabilities of the cartridges being impermeable to water.

According to a first general possibility the fusion and/or gluing, develops inside the ogival closing element at, and in the direction of, the central longitudinal axis, i.e. at the vertex of the ogive. Preferably, the fusion substantially extends for the entire depth of the closing element.

Advantageously, this type of closing element has a very "clean" appearance and it can be easily repeated in series with characteristics that are substantially always the same.

In the case in which there is a glued closure it is preferable for the gluing to be present inside the depressions defined by the wings.

According to another general possibility, which can be applied in addition to or as an alternative to the first possibility, the fusion, at the vertex of the ogive, develops on the external surface of the closing element. Preferably the profile of the closing element is flat, ogival, and/or pressed.

These profiles make it possible to melt the material more easily without leaving holes. It is thus more probable to make cartridges that are waterproof.

According to a second general aspect, the present invention comprises a process for manufacturing a cartridge in which it is forced to take up two configurations in sequence with one another. A first configuration is called partially closed or semi-closed for simplicity, and it corresponds to the semi-closed wings.

In this there is the at least partial fusion of the material that forms the central portion of the closing element. A second configuration is called closed and corresponds to the closed wings. In it there is the solidification of the molten material.

Advantageously, this process can be made both with manual or automatic equipment giving always optimal and especially repeatable manufacturing results. In particular the closure is "clean" and, with more probability, water-proof. Moreover, the force to be applied onto the wings in order to force them into the two closed and semi-closed configurations is minimal, therefore since these are potentially dangerous objects the process is highly reliable. Indeed, the heat is applied in an area that is very far and separated from the gun powder.

According to a third general aspect thereof the present invention concerns a process for manufacturing a cartridge through gluing. The process is different from the previous one substantially due to the fact that instead of melting the central material of the closing element a predetermined amount of glue is inserted inside it.

According to a fourth general aspect thereof the present invention concerns an equipment for making one of the previous processes, characterised in that it comprises a frame that is capable of supporting a device for locking the cartridge and a device for welding or for gluing, where the locking device can be actuated in at least two steps, so that in a first step it forces the wings into the semi-closed configuration, and in a second step it forces the wings into the closed configuration.

Preferably, the locking device comprises a locking element for locking the opening of the cartridge comprising a through hole that is suitable for the partial passage of the crown of wings in an open configuration thereof, and thrust means that can be actuated in at least two steps in which they push the cartridge towards the cavity in such a manner that the edge of the cavity forces the wings towards the partially closed configuration and towards the totally closed configuration, respectively.

Such equipment is advantageously easy and cost-effective to make, it is simple to use and does not modify the cartridge case in an undesired manner.

According to a fifth general aspect thereof, the present invention concerns a process for manufacturing a cartridge, in which an external surface welding is formed on the external surface of the ogival closing element melting the material of the wings when they are in the closed position. Preferably, the welding is flat, ogival or pressed.

According to a sixth aspect thereof the present invention concerns equipment for making the external welding according to the previous process. It comprises a locking element for locking the opening of the cartridge comprising a through cavity that is suitable for the partial passage of the crown of wings, such that the vertex of the ogive remains uncovered for an area that is wider than or equal to 2 mm. For example, the ogive closure projects outside the cavity so as to interact, for example with a welder head, more easily.

Further characteristics and advantages of the present invention shall become clearer from the following detailed description of preferred embodiments thereof, given with reference to the attached drawings and given as an indication and not for limiting purposes. In such drawings.

Figure 3:
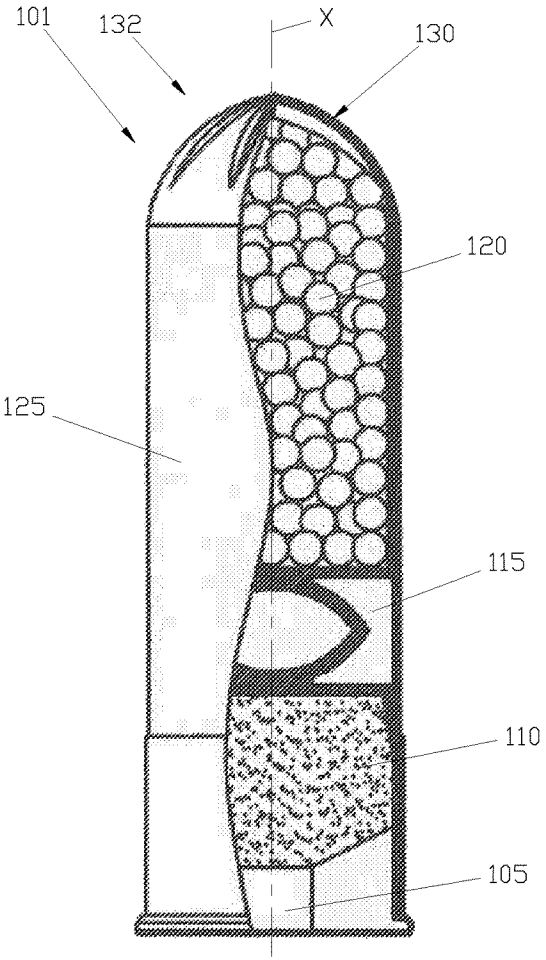
FIG. 3 is a partially sectioned view of a cartridge according to the present invention.

FIGS. 4 to 9 schematically represent the manufacturing steps of the closing element of the cartridge of FIG. 3;

FIGS. 10 to 15 schematically represent alternative closing elements according to the present invention of the cartridge of FIG. 3.

Figure 16:
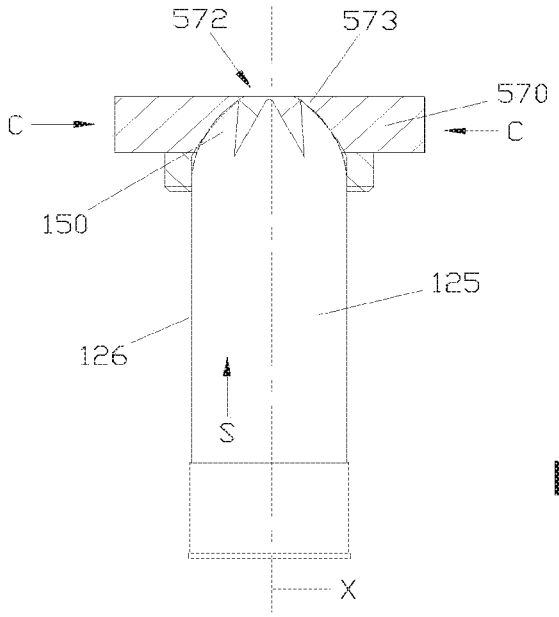
Figure 17:
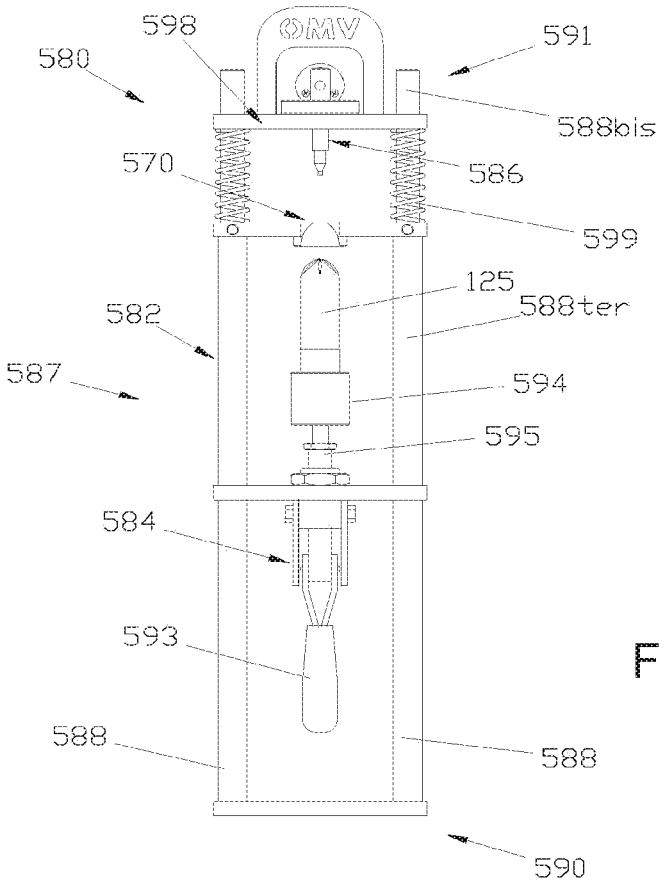
Figure 20:
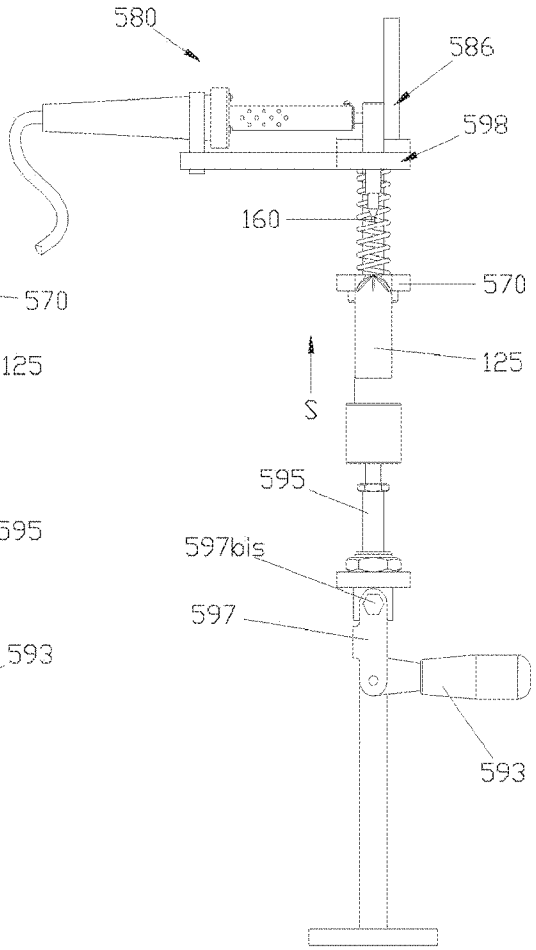
Figure 19:
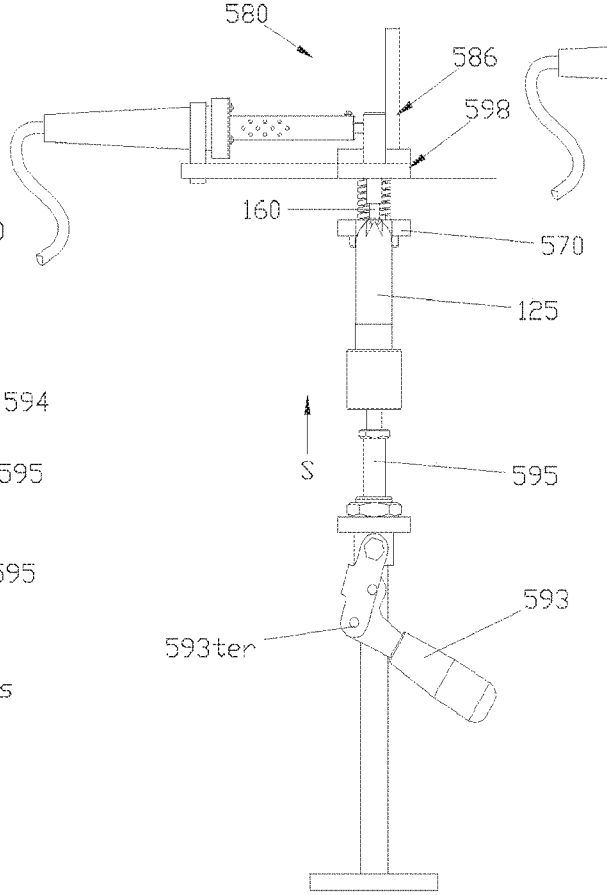
Figure 18:
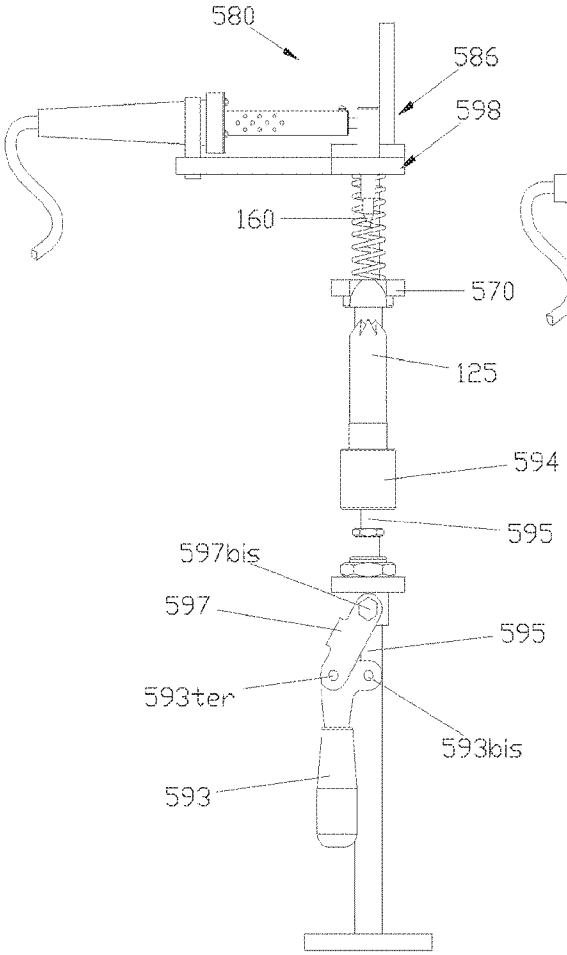

FIG. 16 shows a general view of a base component of an equipment for closing the cartridge cases according to the present invention in a main step of the closing process;

FIG. 17 schematically shows a front view of an equipment that is suitable for making the cartridge of FIG. 3; and FIGS. 18-20 show a side and sectioned view of the equipment of FIG. 17 during 3 respective closing steps of the cartridge case of the cartridge of FIG. 3.

With reference to FIG. 3, this wholly shows, a partially sectioned view of a cartridge 101 according to the present invention.

It comprises a primer 105, a propellant charge 110 (gun powder), a wad 115, a predetermined amount of pellets/shots 20, and the cartridge case 125.

The cartridge case 125 is a cylinder that develops according to a central longitudinal axis X and, when the cartridge is finished, it has an ogival closing element 130 at its longitudinal end 132 that is opposite to the primer 105. The wall 126 of the cartridge case 125 is at least partially yieldable, in a manner such as to be able to form the closing element 130.

In order to best describe the closure 130, in the rest of the description we shall describe its manufacturing process with reference to FIGS. 4 to 9, where in order to make the representation clearer we shall only illustrate the cartridge case 125. A man skilled in the art shall understand that such operations are in reality carried out when the cartridge case is full, i.e. when it contains the primer, the propellant charge, the wad and the pellets/shots.

Figure 1:
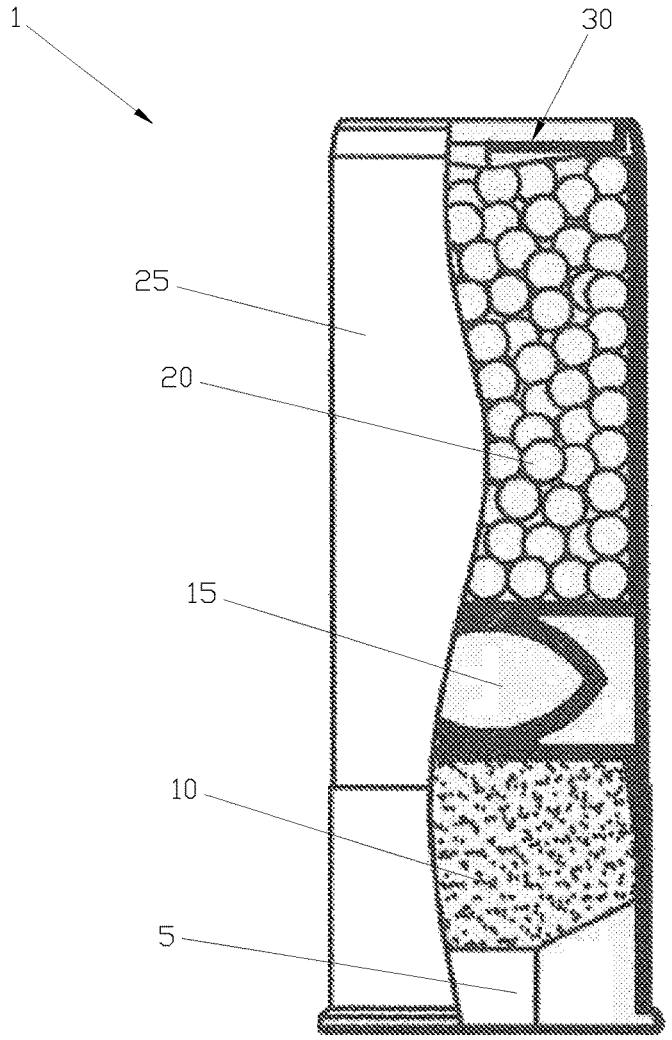
FIG. 1 is a partially sectioned view of a known cartridge.
Figure 2:
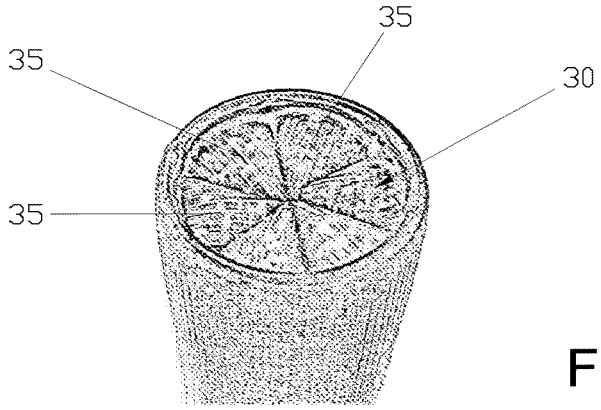
FIG. 2 shows a perspective view of its star-shaped closing element.
Figure 4:
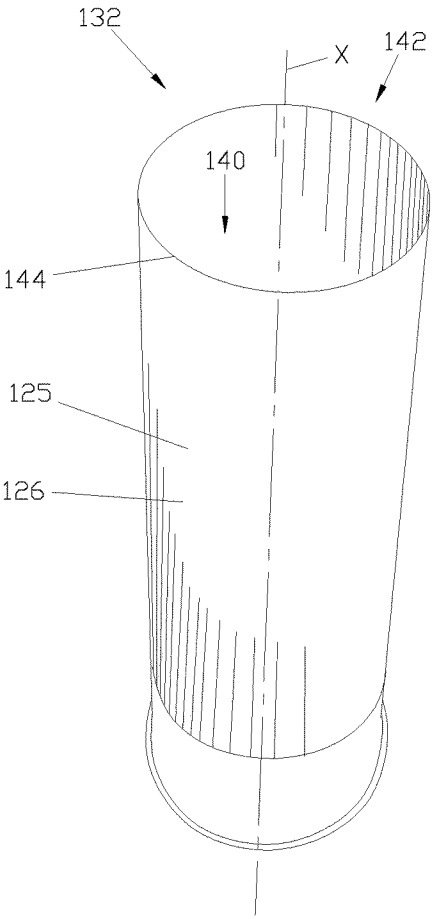

With reference to FIG. 4 the first construction step is shown, in which a cylindrical cartridge case 125 is arranged made from polymer material with an inner chamber 140 and an access opening 142 for accessing the inner chamber at the longitudinal end 132. The opening 142 is defined by a cylindrical edge 144.

Figures 5, 6, 7:
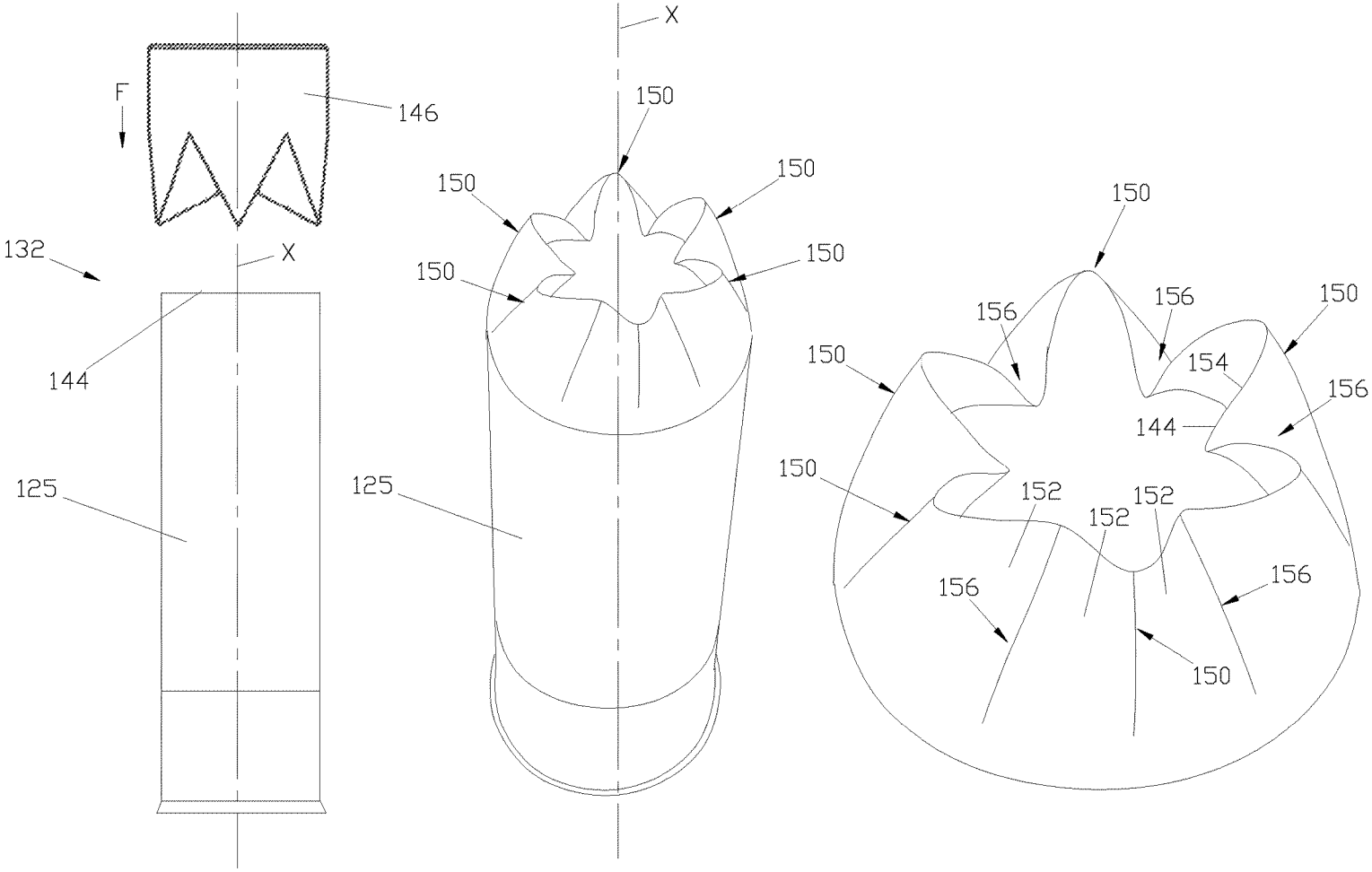

In a second step, shown in FIG. 5, the end 132 is acted upon with a forming tool 146 according to the arrow F, so as to create a crown of wings 150 that develop radially around the central longitudinal axis X and are visible in FIG. 6.

As can be better seen in the enlargement of FIG. 7, the wings 150 are defined by a pair of lateral walls 152, which are arranged substantially so as to form a triangular wedge and by a front surface 154 which coincides with the edge 144 of the cartridge case 125. The wings 150 define, between one another, just as many depressions 156 and are preferably in a number of six.

Figure 8:
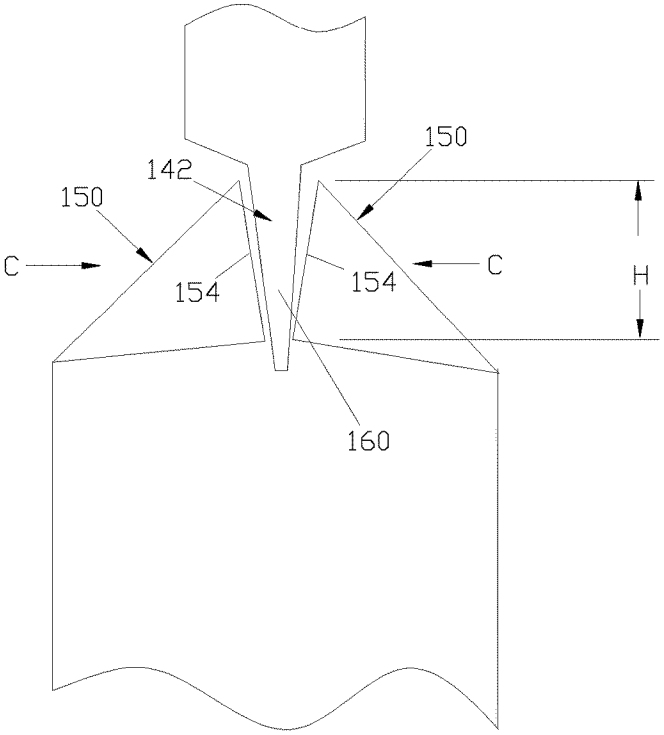

In a subsequent step, shown in FIG. 8, the wings 150 are forced into a first folded configuration in which the access opening 142 is partially closed. The forcing action is indicated by the arrows C.

In this configuration, the opening 142 is just sufficient to allow a welder head 160 to be inserted inside it, with a pin shape with a height H2 at least equal to the height H of the wings 152.

The head 160 is heated, up to a temperature that is sufficient to melt the polymer material of the cartridge case 125, in particular the fusion involves at least the front surface 154, preferably for the entire height H of the wings 152.

Figure 9:
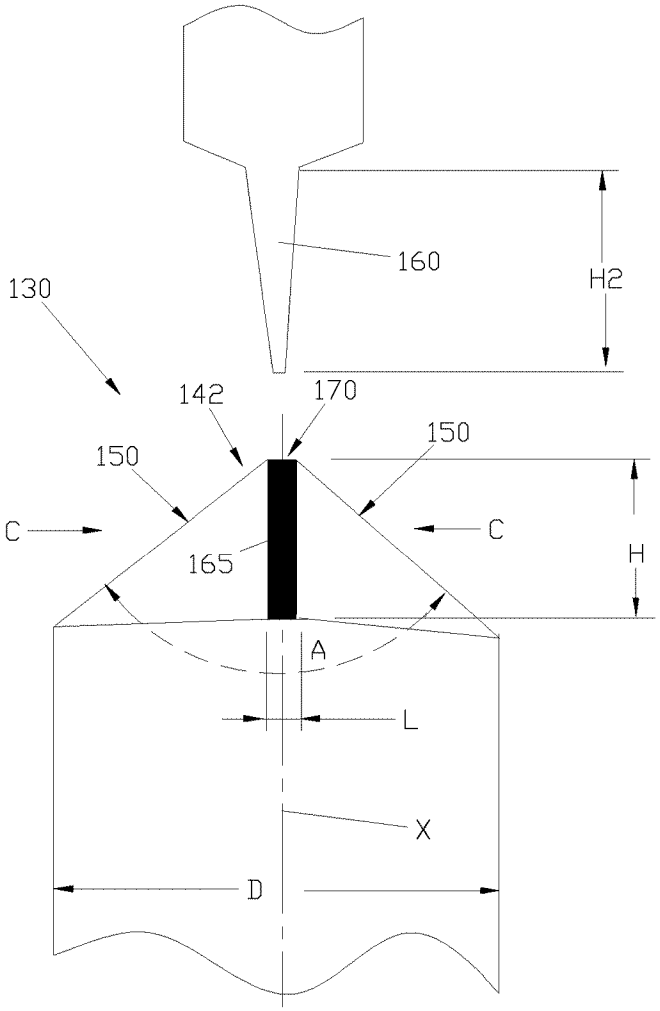

Subsequently, as shown in FIG. 9, the welder head 160 is extracted and the wings 150 are forced into a second folded configuration in which the opening 142 is completely closed when the molten polymer material is still liquid.

The wings 152 are forced to remain in this position until the molten material has solidified forming a central welding 165 at the vertex 170 of the ogive and having a depth H. The wings that are fused in an ogive shape wings 152 form a closing element 130, which is preferably ideally tangent to a cone with an opening A comprised between 30° and 70°, more preferably between 40° and 60°, where substantially 50° is a preferred value.

The central welding 165 fuses together only the front surfaces 154 of the wings, or it preferably has a width L in the direction that is radial with respect to the axis X that is shorter than or equal to 3 mm, more preferably shorter than or equal to 2 mm.

However, a greater welding width should not be excluded, even if it is less preferred, and in any case it should be within the limit L≤¼ D, where D is the diameter of the cartridge case.

The solidified central fusion 165 is the only element for joining the wings 150 in the closed configuration of the closing element 130.

In addition or as an alternative to the process described and illustrated, when the wings 152 are in the semi-closed configuration of FIG. 8, it is possible to insert a predetermined amount of glue in the receptacle defined by the partially closed opening 142 and/or between the wings. Subsequently, the wings are forced into the closed position of FIG. 9 and are kept in such a position until the glue has become solid.

The gluing process can be advantageously used also for closing cardboard cartridge cases.

In the rest of the description we shall describe some alternative embodiments of the invention in which same or similar elements are indicated with the same reference numerals used and increased by 100 or a multiple thereof.

Figures 10, 11, 12, 13, 14, 15:
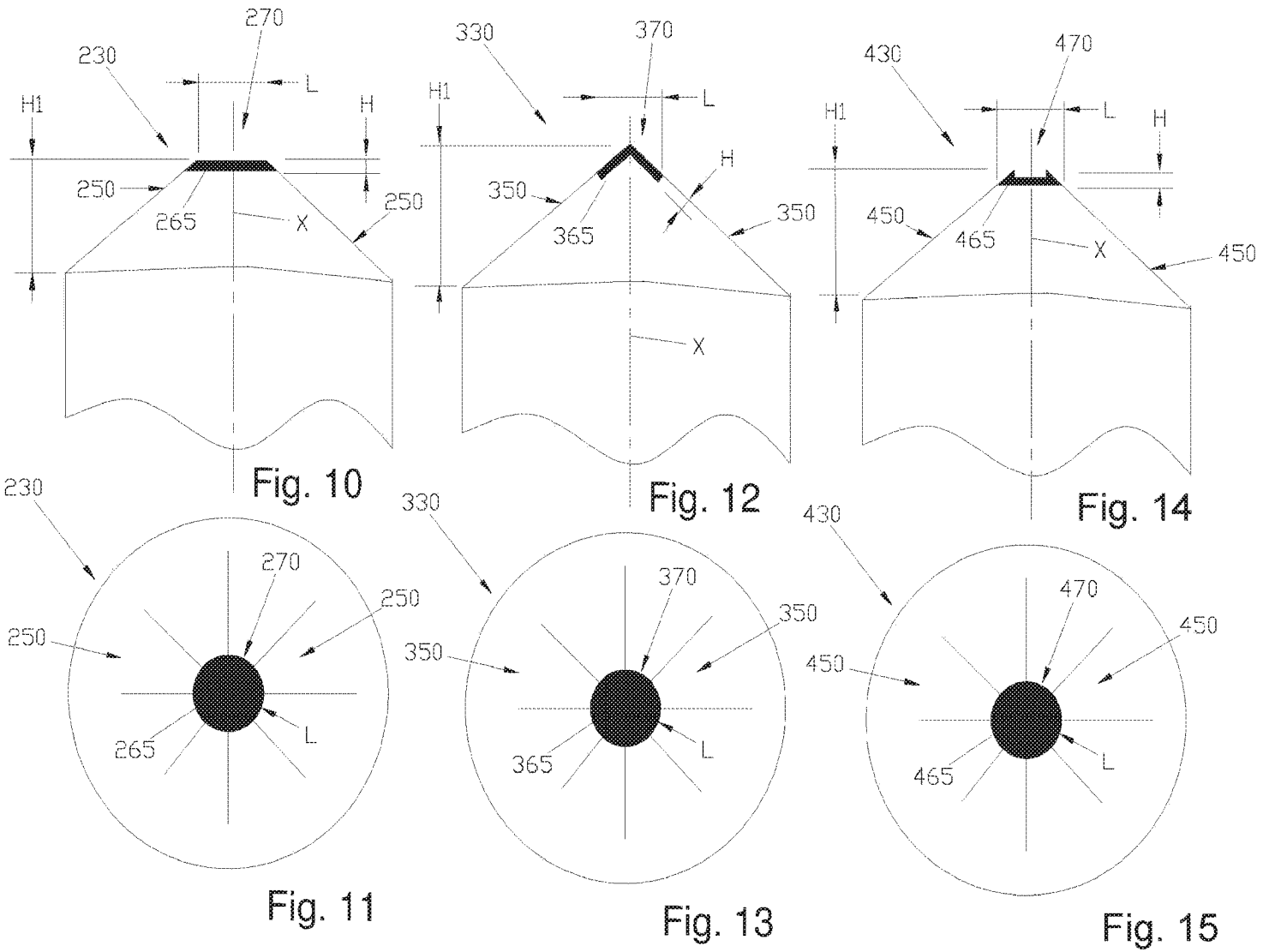

FIGS. 10 and 11 illustrate a second type of closing element 230 of the cartridge case which differs from the closure 130 of FIG. 9 for the fact that it comprises, as the joining element, only a central solidified external surface fusion 265 that keeps the wings 250 closed.

Such a fusion is at the vertex 270 of the ogive.

The external solidified fusion 265 is flat and has a maximum width L in the direction that is perpendicular to the axis X that is shorter than or equal to 3 mm, preferably shorter than or equal to 2 mm. Other measurements can be acceptable but in any case within the limit L≤¼ D, where D is the diameter of the cartridge case.

The solidified fusion 265 has a depth H that is smaller than or the same as the depth H1 of the closing element 230, wherein the latter coincides with the height of the wings 250 in the closed position.

FIGS. 12 and 13 illustrate a third type of closing element 330 of the cartridge case that differs from the closure 230 of FIG. 10 for the fact that the external solidified fusion 365 that keeps the wings 350 closed has an ogival profile, preferably so as to reflect the profile of the entire ogival closing element 330. Such a fusion is at the vertex 370 of the closing element 330 and its maximum width L and depth H are like for the closing element 230.

FIGS. 14 and 15 illustrate a fourth type of closing element 430 of the cartridge case that differs from the closure 230 of FIG. 10 for the fact that the external solidified fusion 465 that keeps the wings 450 closed has a pressed profile. Such a welding is at the vertex 470 of the closing element 430 and its maximum width L and depth H are like for the closure 230.

The process for carrying out the solidified surface fusion 265, 365 and 465 differs from that illustrated above for the fusion 165 for the fact that it is possible to skip the step in which the wings are forced into the intermediate closing configuration and to pass directly on to the step in which they are forced into the total closing configuration of the opening 142.

In such a configuration a welder head is rested on the vertex, said head being respectively flat, ogive or of the desired pressed shape.

With reference now to FIG. 16, and for the sake of simplicity to the cartridge case 125 of FIG. 3, it should be observed that in general in order to force the wings 150 into the closed and/or semi-closed position it is possible to use an abutment element 570 with a through hole 572 with a diameter such as to allow the cartridge case to only partially enter, in particular only the wings 150 or only part of them. This is possible since the wings, even in the resting position, are tapered with respect to the cylindrical body 126 of the cartridge case 125. When the wings 150 are inserted in the hole 572 a thrusting action is exerted onto the cartridge case 125 towards the abutment element 570 along the longitudinal axis X (arrow S in the figures). In such a way the edge 573 of the hole 572 forces the wings 150 to fold towards the central axis X more with respect to the resting position (direction C), and therefore to take up the closed and/or semi-closed position.

The hole 572 preferably has a section such as to form a housing chamber for housing at least partially the crown of wings 150, for example an ogival section, preferably a dome-shaped section. In other words the abutment element 570 forms a cap that is perforated at the centre for the cartridge case 125.

The upper part of the hole 572 can be used so as to allow the crown of wings 150 to partially come out from the housing seat and/or to allow a welder head to enter.

As visible in FIG. 17, the abutment element 570 can be part of a building equipment 580 that comprises a frame 582, a thrusting device 584 and a welding device 586, where the thrusting device 584 and the abutment element 570 define a locking device 587 of the cartridge case, as shall become clearer in the rest of the description.

The frame comprises a pair of parallel rods 588 and the abutment element coupled with them in a fixed manner, in an intermediate position between their ends 590, 591. It is preferably made in the form of an annular interchangeable annular element so as to adapt to various gauges.

The thrusting device 584 is fixed to the rods 588 between the abutment element 570 and their lower end 590, whereas the welding device 586 is fixed to their upper end 591.

The thrusting device 584 comprises a lever 593 with three predetermined positions that actuates a cartridge case carriage 594. In particular the movement of the lever 593 for passing from one predetermined position to the other moves the carriage 594 closer or away, and therefore the cartridge case to/from the abutment element 570 through a push rod 595. The latter has a length that can be adjusted so as to adjust the initial position of the carriage based upon the gauge of the cartridge. The adjustment for example is made through an adjustment screw.

The construction and the operation of the lever in the three positions can be understood better with reference to FIGS. 18, 19, and 20 partially in section so as to clarify the description.

FIG. 18 corresponds to a resting position in which the lever 593 does not exert any thrust and wherein the cartridge case 125 is not inserted in the housing chamber 572 and therefore its wings 150 are in the resting position (i.e. like in FIG. 6, straight after they have been formed).

As can be noted the lever 593 has the shape of an elbow, and is hinged in a tilting manner at one end thereof 593*bis* to the sliding rod 595 of the carriage 594, and at the elbow 593*ter* to a joining element 597. The latter is, in turn, tiltingly hinged to the frame 582 in a point 597*bis*.

As visible in FIG. 19, when the lever 593 rotated around the hinging point 593*ter* it causes a first lifting S of the push rod 595 in the direction of the abutment element 570. The lever 593 can be rotated around the hinging point 593*ter* of the elbow until a first stable position has been reached. In such a position the cartridge case 125 is pushed against the ring 570 and it thus remains locked, taking up the partially closed configuration of FIG. 8.

As visible in FIG. 20, the lever 593 in its first stable position and the tilting joining element 597 can be rotated together around the hinging point 597*bis* to the frame until a second stable position has been reached. This movement leads to a further lifting of the push rod 595, with a smaller amount than the previous one, and to the reaching of the completely closed configuration by the cartridge case 125, by effect of the thrust S against the fixed ring 570.

With reference again to FIG. 17, it can be noted that the welding device 586 is mounted on a slide 598 that is mobile parallel with respect to the rods 588 moving toward or away from the abutment element 570. This is made for example by coupling the slide 598 with two portions of rods 588*bis* that are telescopically mobile with respect to the remaining fixed portions of rods 588*ter*, and are limited in their movement by helical springs 599. Such a slide 598 can be manually actuated.

As visible in FIG. 18, in the resting configuration in which the cartridge case is not yet in abutment against the stopping ring 570, the welding device 586 is left in a totally raised position with respect to the ring 570 in which it is not operative.

FIG. 19 shows that when the lever 593 is in the first stable position forcing the cartridge case against the ring 570 in the semi-closed configuration, the slide 598 is lowered until the pin-shaped welder head 160 penetrates the crown of semi-closed wings 150.

At this point it is necessary to wait the time needed for the welder head, of course hot, to partially melt the polymer that the wings 150 are made from (as already described more in general with reference to FIGS. 8 and 9), after which the welder head 160 is extracted from the crown of semi-closed wings 150 by raising the slide 598 into the position shown in FIG. 20.

At this point the lever 593 is brought into its second position (FIG. 20) to totally close the wings 150 and keep them in such a position until the molten material has solidified.

With the same or with slightly modified equipment it is possible to also make closing elements for closing the cartridge case through external welding like those of FIGS. 10-15 or through gluing.

For example in order to make the external welding of FIGS. 10-15 it is sufficient to provide a ring 570 with a hole 572 that is slightly wider, (for example with a diameter that is greater than or equal to 2 mm, more preferably to 3 mm, in such a manner that it is still suitable for holding the cartridge case in abutment but allows a greater area around the vertex of the wings to be left uncovered.

The equipment 580 is positioned directly in the second stable configuration of the lever 593, in which the wings are closed, and the welder head is applied directly onto the vertex 270, 370, 470 formed by the closed wings.

In order to carry out gluing it is on the other hand possible to replace the welding device 586 with a glue dispensing device. In the case in which it is desired for there to be gluing inside, the glue is inserted in the semi-closed opening of the crown of wings when the lever 593 is in its first stable position.

Subsequently, the lever 593 is brought into the second stable position so as to close the wings and force them to remain in such a position until the glue is solidified. The closure is thus made by the wings themselves being glued to one another.

In general it can be seen that in addition to the fusion through contact with a welder head at a temperature that is the same or greater than that at which the material of the cartridge case melts, it is possible to use any other type of welding. For example it is possible to use a welding in which the material is fused through ultra-sound. The other types of welding can be easily applied for example by replacing the welding device 586 of the equipment 580 with a suitable welding device.

In general it can be seen that both in the case of fusion and in gluing, if the molten material or the glue are thermoplastic or thermosetting materials it is possible to accelerate the solidification process by forcibly cooling down or heating up the closing element.

Although types of closures exclusively with internal fusion or gluing or exclusively with external surface fusion have been described up to now, it should also be observed that the man skilled in the art will understand that also every other type of combination between these closures are possible, for example with both internal and external welding.

For example, they can be easily made with the equipment described by modifying the welder head so it can simultaneously carry out both the, inner and external surface fusions, or even more simply in two steps, in which for example the first inner fusion is carried out with a first welder head and subsequently the external surface fusion is carried out with a second welder head.

Of course, the embodiments and the variants described and illustrated so far are purely described as an example and a man skilled in the art, in order to satisfy specific and contingent requirements, can carry out numerous modifications and variants to these, among which for example the combination of said embodiments and variants, all moreover contained in the scope of protection of the present invention as defined by the following claims.

The invention claimed is:

1. Process for manufacturing a cartridge (101), comprising the following steps:

providing a cartridge case (125) made from a polymer material with an inner chamber (140) defined by at least one at least partially yieldable wall (126), said cartridge case developing around a central longitudinal axis (X) and has two ends (105, 132) in the longitudinal direction, one of which has an access opening (142) for accessing the inner chamber (140), said cartridge case (125), inside the inner chamber, containing at least one primer (105), an propellant charge (110), a wad (115) and a plurality of at least one of pellets or shots (120), making a crown of wings (150) that develops around the central longitudinal axis (X) at said opening by folding an edge (144) of the cartridge case;

forcing the wings (150) into a first folded configuration partially closing the opening (142);

at least partially fusing the polymer material forming the cartridge case substantially for an entire height (H) of the wings (150) in a direction of the central longitudinal axis (X) at least at a front surface of an edge (154) of the wings; said fusing taking place in said first folded configuration;

forcing the wings (150) into a second folded configuration completely closing the opening (142) when the fused polymer material is still liquid; and forcing the wings (150) to remain in the second folded configuration until the fused material is solidified.

2. The process according to claim 1, wherein a welder head (160) inserts in the partially closed opening (142) at the central longitudinal axis (X) to carry out said fusing of the polymer material, the welder head (160) being pin-shaped with a height (H2) at least equal to the height (H) of the wings (150).

3. The process according to claim 1, wherein in the second folded configuration the wings are disposed to form an ogival closure for said aperture.

* * * * *